US006138764A

United States Patent [19]

Scarsdale et al.

[11] Patent Number: 6,138,764

[45] Date of Patent: Oct. 31, 2000

[54] SYSTEM AND METHOD FOR DEPLOYING A WIRELINE RETRIEVABLE TOOL IN A DEVIATED WELL

[75] Inventors: Kevin T. Scarsdale; Marvin A. Keller, both of Bartlesville, Okla.; Peter Schrenkel, Carrollton, Tex.

[73] Assignee: Camco International, Inc., Houston, Tex.

[21] Appl. No.: 09/299,424

[22] Filed: Apr. 26, 1999

[51] Int. Cl.[7] ..... E21B 7/08

[52] U.S. Cl. ..... 166/382; 166/383; 166/384; 166/385; 166/386; 166/387; 166/117.6

[58] Field of Search ..... 166/77.2, 117.5, 166/117.6, 50, 382–387

[56] References Cited

U.S. PATENT DOCUMENTS

| | | | |
|---|---|---|---|
| 3,844,346 | 10/1974 | Mott | 166/212 |
| 3,957,119 | 5/1976 | Yonker | 166/315 |
| 4,671,358 | 6/1987 | Lindsey, Jr. et al. | 166/291 |
| 5,871,051 | 2/1999 | Mann | 166/377 |

*Primary Examiner*—Roger Schoeppel

*Attorney, Agent, or Firm*—Fletcher, Yoder & Van Someren

[57] ABSTRACT

A method for deploying a progressing cavity pump in a deviated well. The method allows a wireline deployment system to be used in moving a progressing cavity pump through a deviated well. The wireline is connected to a pump-down tool which is lowered into the production tubing. The pump-down tool allows a seal to be formed between an interior surface of the production tubing and the pump-down tool. This allows pressure, such as hydraulic pressure, to push the progressing cavity pump through well deviations to a desired location.

20 Claims, 5 Drawing Sheets

34
44
14
26
12
15
10
24
42
38
32
40
34
28
30
36
28
16
18
46
20
58
50
56
22
52
60
54
48

SYSTEM AND METHOD FOR DEPLOYING A WIRELINE RETRIEVABLE TOOL IN A DEVIATED WELL

FIELD OF THE INVENTION

The present invention relates generally to a system and method for deploying a wireline retrievable device, such as a progressing cavity pump, in a downhole environment within a wellbore, and particularly to a system and method that allows such devices to be deployed by a wireline in deviated wells.

BACKGROUND OF THE INVENTION

A variety of tools and other equipment are used in downhole, wellbore environments. For example, a progressing cavity pump may be utilized in producing petroleum and other useful fluids from production wells. When a progressing cavity pump system is used, a production tubing is disposed within a wellbore to extend through the wellbore to the progressing cavity pump system disposed at a specific location within the well. The progressing cavity pump can be deployed or retrieved through the center of the production tubing, via a wireline.

In operation, fluids contained in an underground formation enter the wellbore via perforations formed through a wellbore casing adjacent a production formation. Fluids, such as petroleum, flow from the formation and collect in the wellbore. The pump, such as the progressing cavity pump, moves the production fluids upwardly through the production tubing to a desired collection point.

Progressing cavity pump systems, as well as other devices and systems, often are deployed by a wireline and are retrievable by a wireline. The wireline is utilized to lower the retrievable object through the hollow center of the production tubing to a landing nipple of the production tubing at a desired location in the wellbore. The retrievable object may be sealed to an interior surface of the landing nipple by an appropriate seal to prevent drainage of the production tubing as produced fluid is pumped or lifted towards the surface of the earth.

For example, in a progressing cavity pump system, the system typically includes a downhole, latching device, such as an Otis style X-lock. The latching device includes the seal or seals that act against the interior surface of the production tubing to prevent drainage. Additionally, the latching device may be coupled to a wireline to facilitate both deployment and retrieval of the progressing cavity pump.

This conventional arrangement works well if the wellbore remains generally vertical, but it can be difficult to move an object through a deviated portion of a wellbore. For example, wellbores may be deviated thirty degrees, forty five degrees or even ninety degrees from a generally vertical orientation. The wireline simply is not able to force the object through these deviated portions of the wellbore to the desired end location. Stiffer deployment mechanisms, such as coiled tubing, can be used in place of a wireline to push the objects through a deviated well. However, such mechanisms tend to be more expensive and more difficult to use.

It would be advantageous to have a pump-down tool that could be attached to the downhole components, e.g. progressing cavity pump, that would allow the downhole tool or tools to be moved through a deviated well while connected to a wireline.

SUMMARY OF THE INVENTION

The present invention features a method of deploying a downhole tool in a deviated well having a production tubing disposed within a wellbore casing lining the wellbore. The method includes attaching a wireline deployed pump-down tool to a downhole object or tool to form a tool string. The method further includes lowering the tool string into the production tubing, and forming a seal between the wireline deployed pump-down tool and an interior surface of the production tubing. The method also includes pushing the tool string to a desired location by applying a hydraulic pressure to the wireline deployed pump-down tool.

According to another aspect of the invention, a wireline deployed pump-down tool system is provided for deploying a downhole tool through a tubing disposed through a deviated well. The system includes a wireline deployed pump-down tool that has an upper assembly, a lower assembly and a flexible member. The upper assembly is designed for attachment to a wireline deployment system. The lower assembly is designed for releasable attachment to a downhole tool, such as an Otis style X-lock. The flexible member is designed for connection between the upper assembly and the lower assembly. Furthermore, the upper assembly and the lower assembly are slideably engaged such that when they are moved to a first, contracted position, the flexible member is forced into contact with an interior surface of the tubing. However, when the upper assembly and the lower assembly are slid to a second, extended engagement position, the flexible member is withdrawn from the interior surface, and the pump-down tool is disengaged from the interior surface for removal from the wellbore.

According to another aspect of the present invention, a method is provided for deploying a downhole tool through a tubing disposed in a deviated well. The method comprises attaching a pump-down tool to a progressing cavity pump. The method further includes lowering the progressing cavity pump and the pump-down tool into the tubing. The method further includes forming a seal between the pump-down tool and an interior surface of the tubing, and applying a pressure to the pump-down tool. Additionally, the method includes moving the progressing cavity pump through a deviation in the tubing that would otherwise hinder the movement of the progressing cavity pump to a desired location.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
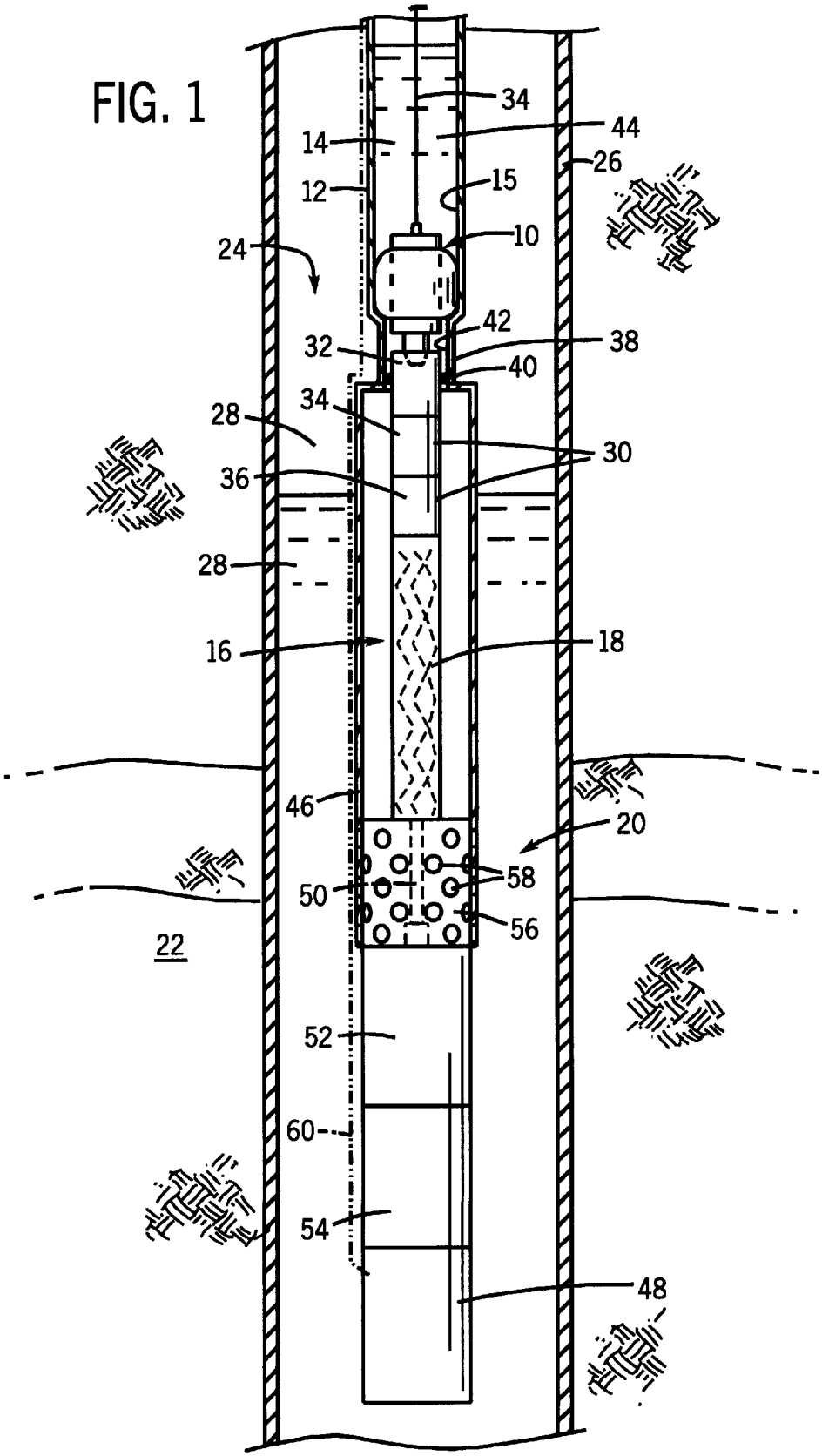
FIG. 1 is a front elevational view of a deployment system positioning a retrievable object in a wellbore, according to a preferred embodiment of the present invention.

Referring generally to FIG. 1, a pump-down tool 10, according to a preferred embodiment of the present invention, is illustrated in an exemplary downhole application. In this application, a string of tubing, such as production tubing 12, is deployed in a well. The production tubing 12 includes a hollow interior 14 defined by an interior surface 15, through which a retrievable object 16 may be deployed, and through which production fluids may be pumped.

In the particular example illustrated, retrievable object 16 comprises a downhole pump 18, such as a progressing cavity pump, commonly known as a PC pump. Progressing cavity pump 18 is appropriately sized for deployment and retrieval through hollow interior 14 of production tubing 12.

Typically, pump 18 is designed for deployment in a well 20 within a geological formation 22 containing desirable production fluids, such as petroleum. In a conventional application, a wellbore 24 is drilled and lined with a wellbore casing 26. Pump 18 is deployed within wellbore 24 at a desired location for pumping a wellbore fluid 28.

In this embodiment, retrievable object 16 may include one or more components 30 along with progressing cavity pump 18. For example, components 30 may include jars, weight bars, skates, latching tools and a variety of other components known to those of ordinary skill in the art. Pump-down tool 10 is connected to retrievable object 16 by a latching device or lock 32, such as an Otis style X-lock by which pump-down tool 10 may be selectively connected or disconnected from retrievable object 16. A variety of latching devices are known to those of ordinary skill in the art.

Furthermore, a wireline 34 is connected to pump-down tool 10 on a side generally opposite latching device 32. Wireline 34 allows progressing cavity pump 18 and the remainder of retrievable object 16 to be lowered through the interior 14 of production tubing 12. Typically, the retrievable object 16 is lowered to a landing nipple 38 of production tubing 12. The latching device 32 may include an outer seal or seals 40 that engage or mate with an inside surface 42 of landing nipple 38. Typically, landing nipple 38 has a smaller diameter than the remainder of production tubing 12.

Seals 40 create a seal between retrievable object 16 and production tubing 12 to prevent drainage of any column of fluid 44 accumulated in production tubing 12. In operation, the column of fluid 44 may be created as pump 18 pumps wellbore fluid 28 through components 30 and latching device 32 into the hollow interior 14 of production tubing 12.

In the particular example illustrated, retrievable object 16 comprises progressing cavity pump 18 and other components 30. In a progressing cavity pump system, there are additional features and components. For example, a canister extends downwardly to approximately the lower end of pump 18 when pump 18 is engaged in an operable position, as illustrated in FIG. 1. Beneath canister 46, a motor 48 is coupled to pump 18 via a shaft 50 extending to the progressing cavity pump 18. Motor 48 is connected to shaft 50 through a gear box 52 to reduce the speed at which shaft 50 is rotated. Also, a motor protector 54 often is connected between motor 48 and gear box 52 to help isolate motor 48, and particularly its internal motor oil, from the wellbore fluid 28. A pump intake 56, having a plurality of intake openings 58, is provided between gear box 52 and pump 18 to facilitate the intake of wellbore fluid 28.

Generally, progressing cavity pump systems, such as that illustrated in FIG. 1, are designed such that canister 46, along with motor 48, gear box 52, motor protector 54 and pump intake 56, remain in the downhole environment. Pump 18, however, may be independently deployed and retrieved from the downhole environment by wireline 34 and pump-down tool 10. Power is provided to motor 48 by a power cable 60 that typically runs along the outside of production tubing 12.

Figure 2:
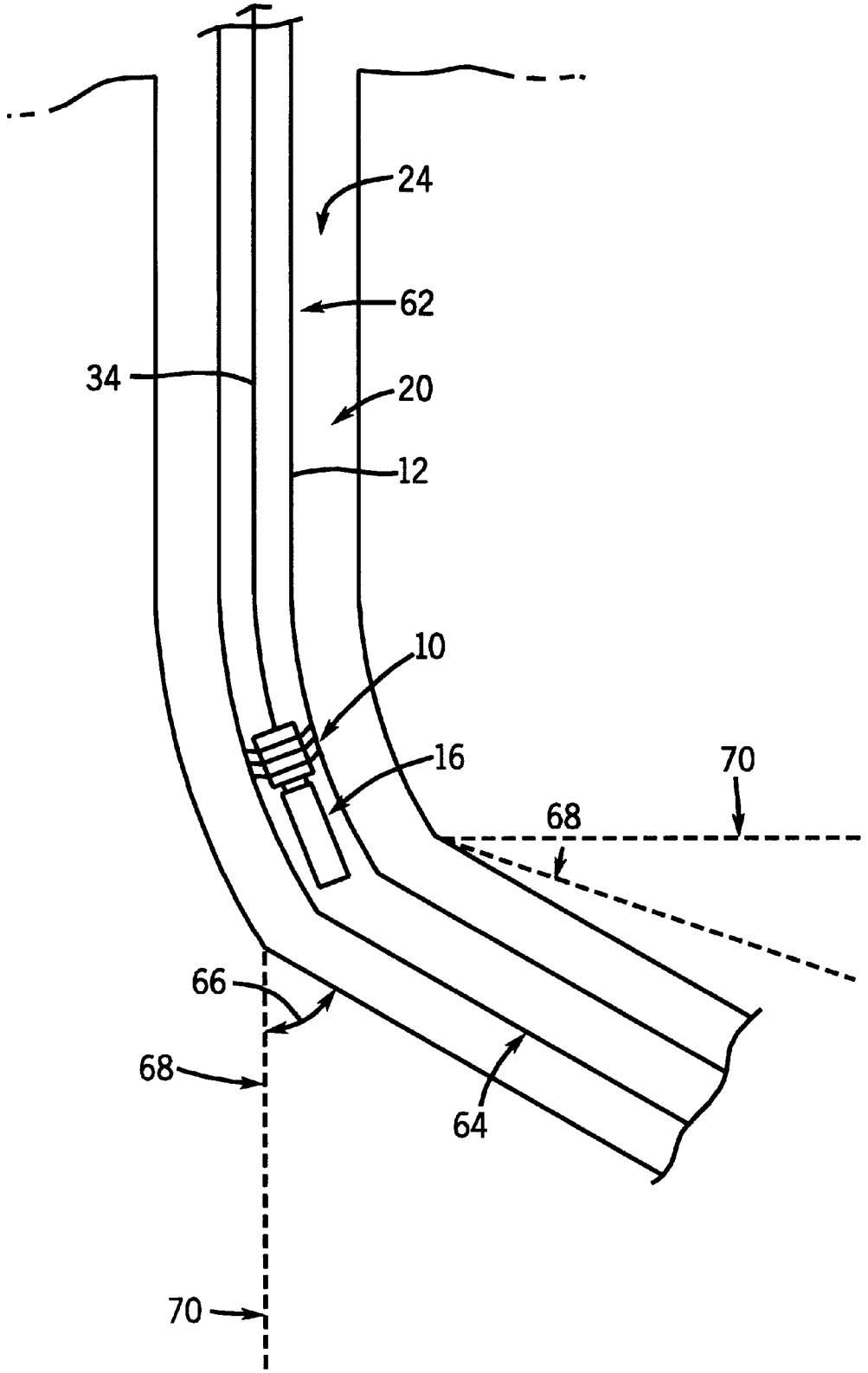
FIG. 2 is a front elevational view of a retrievable object being moved through a deviated wellbore.

Referring generally to FIG. 2, a deviated well 20 is illustrated. In a deviated well, the wellbore 24 typically includes at least a vertical section 62 and a deviated section 64. There also may be additional changes in direction or orientation of the wellbore before reaching the end or desired location for the retrievable object 16, as illustrated in FIG. 1. Deviated section 64 may be at a variety of angles with respect to section 62. For example, deviated section 64 may deviate at least thirty degrees, as illustrated by angle 66; it may deviate forty five degrees or more as indicated by angle 68; or it may deviate through an angle 70 of approximately ninety degrees to a generally horizontal orientation. These are some examples of a single deviation that a given wellbore 24, as well as the production tubing 12, may incur in a deviated well.

The deviations create difficulty in utilizing a wireline to deploy a retrievable object 16, such as the progressing cavity pump 18. Thus, pump-down tool 10 allows interior 14 of production tubing 12 to be pressurized above pump-down tool 10. Typically, the pressure is provided by a column of fluid under pressure that forces pump-down tool 10 and object 16 into and through each deviated section 64 without allowing the retrievable object 16 to become caught or "hung-up" in a deviated section. Once retrievable object 16 is deployed at a desired location, as illustrated in FIG. 1, the latching device 32 can be utilized to release pump-down tool 10 from object 16, such that the pump-down tool may be retrieved via wireline 34. Similarly, object 16 may be retrieved by forcing pump-down tool 10 into engagement therewith via latching device 32. The entire tool string can then be retrieved through the deviated production tubing via wireline 34.

Figure 3:
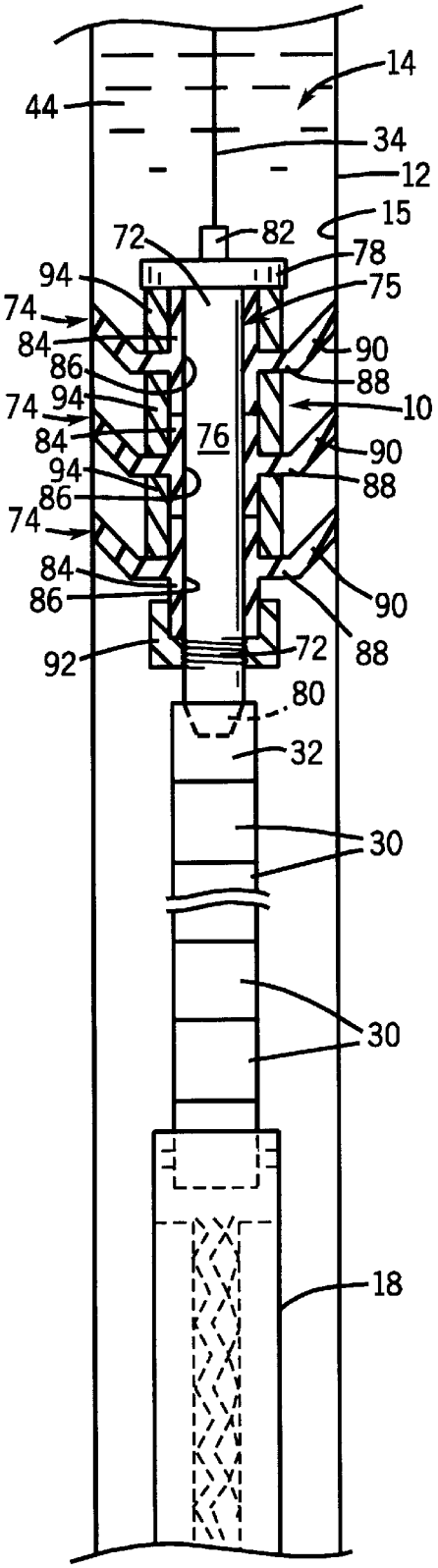
FIG. 3 is a front elevational view of a first embodiment of a pump-down tool, according to an embodiment of the present invention.

Referring generally to FIG. 3, an exemplary embodiment of pump-down tool 10 is illustrated. In this embodiment, pump-down tool 10 includes a support structure 72 to which at least one and preferably a plurality (e.g., 3) of sealing members 74 are mounted. In this embodiment, support structure 72 includes a central mandrel 75 having a shaft 76 to which a top plate 78 is affixed. At an opposite end of central shaft 76, support structure 72 includes an attachment end 80 appropriately designed for engagement with latching device 32. The exact design of attachment end 80 is formed according to the particular latching device utilized. A connector 82 is mounted to top plate 78 for connection to wireline 34.

Each sealing member 74 preferably includes a hub portion 84 that is annular in shape and includes a central opening 86 through which central shaft 76 is received. Each sealing member 74 also includes a radially extending portion 88 that extends outwardly from hub portion 84 to an inside surface 15 of production tubing 12 that defines hollow interior 14. Preferably, each radially extending portion includes an outer upturned region 90 that facilitates sealing engagement between pump-down tool 10 and the interior surface of production tubing 12.

Additionally, pump-down tool 10 may include a retainer 92 that engages central shaft 76 opposite top plate 78 to secure the one or more sealing members 74 therebetween. Retainer 92 may be threadably engaged with central shaft 76. Additionally, pump-down tool 10 may include a plurality of spacers 94 disposed between sequential sealing members 74.

Preferably, support structure 72 and retainer 92 are made from a relatively hard material, such as steel. The sealing members 74, on the other hand, are made from a softer, preferably elastomeric material, such as a plastic or synthetic rubber, that can readily create a seal with the interior surface of production tubing 12.

In operation, a column of fluid 44 is placed in hollow interior 14 above pump-down tool 10. The fluid is caught by the radially extended portions 88, and particularly by the upturned regions 90, and the pressure created by the fluid column forces upturned regions 90 into relatively firm engagement with the interior surface of production tubing 12. Thus, additional pressure may be applied to column of fluid 44 to drive or force pump-down tool 10 as well as retrievable object 16 through deviations in production tubing 12 formed along its route through deviated well 20. Effectively, each sealing member 74 provides cup-shaped members to create the necessary seal that allows the retrievable object, e.g. progressing cavity pump, to be moved through a variety of deviations in the well.

Figure 4:
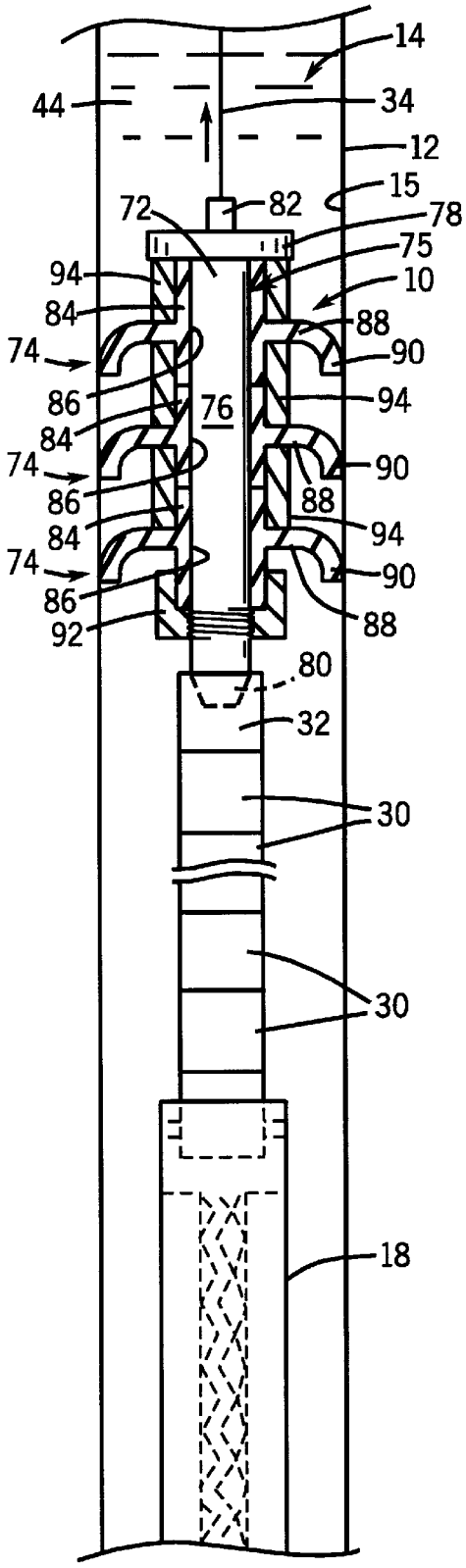
FIG. 4 is a front elevational view similar to FIG. 3 but showing the pump-down tool being removed from the well.

When the pump-down tool 10 or the pump-down tool 10 in combination with the retrievable object 16 are to be retrieved, an axial, reverse force is exerted on wireline 34. This axial force pulls support structure 72 in a reverse direction through interior 14, which tends to fold over or invert the cup-like structures formed by radially extended portions 88 and upturned regions 90. As illustrated best in FIG. 4, the upturned regions 90 fold back, e.g. downwardly, and allow the pump-down tool 10 and retrievable object 16, e.g. progressing cavity pump 18, to readily be retrieved through production tubing 12.

Figure 5:
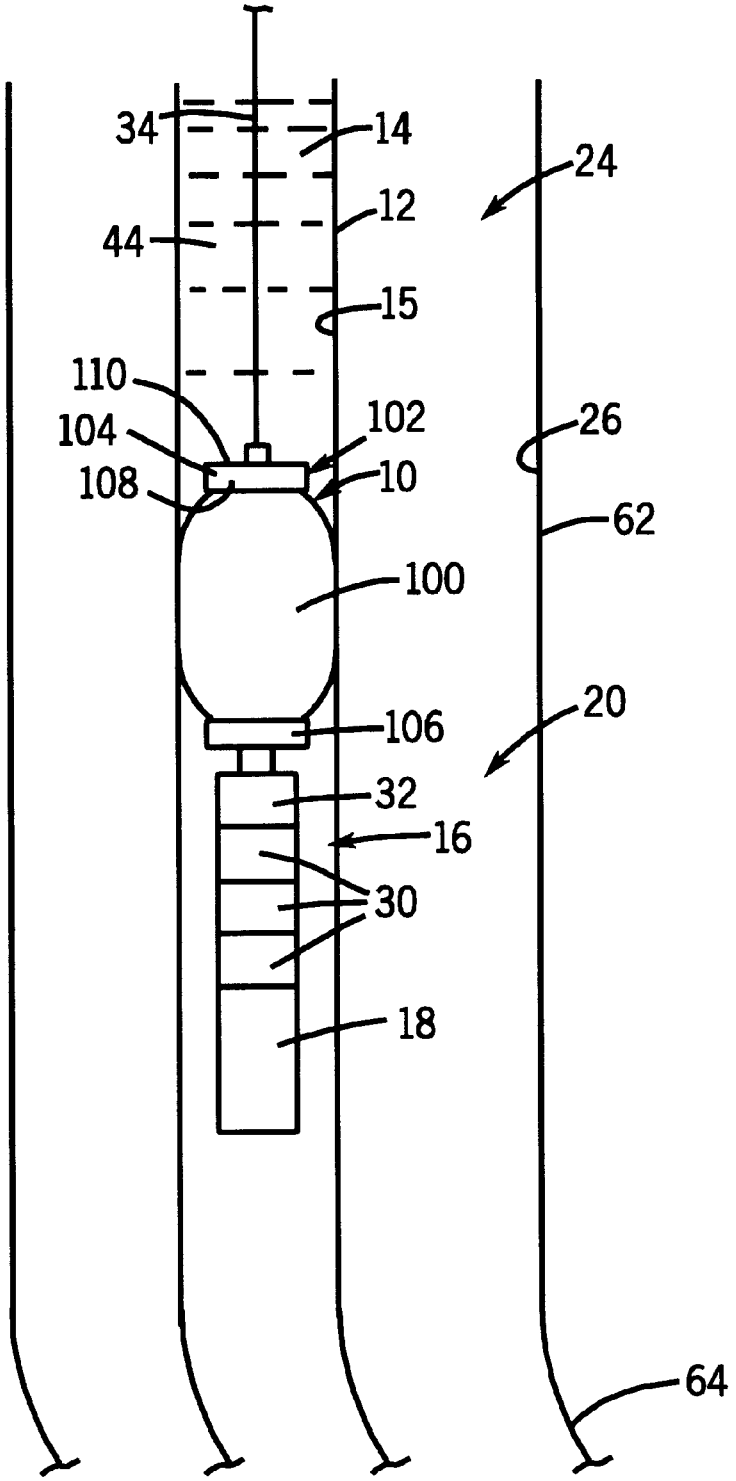
FIG. 5 is a front elevational view of an alternate embodiment of the present invention.
Figure 6:
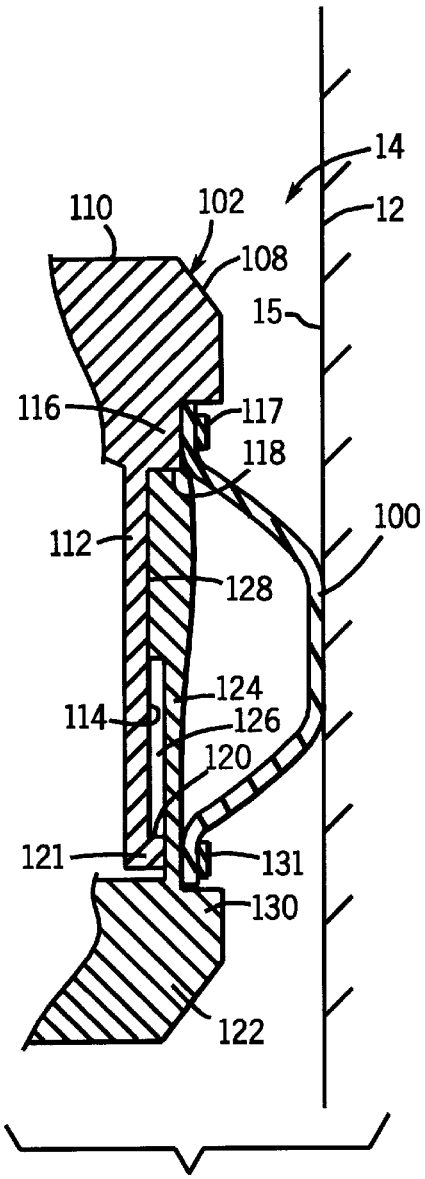
FIG. 6 is a partial cross-section taken generally along the axis of the pump-down tool illustrated in FIG. 5.
Figure 7:
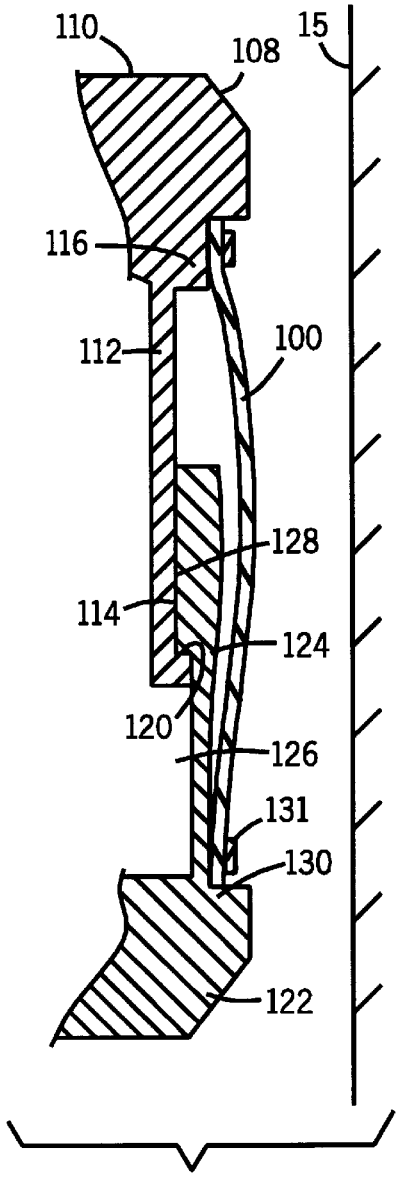
FIG. 7 is a partial cross-sectional view similar to that of FIG. 6 but showing the pump-down tool in a disengaged configuration for removal.

An alternate embodiment of the pump-down tool 10 is illustrated in FIGS. 5–7. Referring specifically to FIG. 5, this embodiment of pump-down tool 10 can be connected to a retrievable object 16 as described with reference to the embodiment illustrated in FIGS. 3 and 4. Additionally, wireline 34 may be connected to an opposite side of the pump-down tool from the attached retrievable object.

In the embodiment illustrated in FIG. 5, the pump-down tool 10 includes a sealing member 100, that preferably comprises an elastomeric member, such as a synthetic rubber or other plastic seal material. Sealing member 100 is connected to a support structure 102 that permits sealing member 100 to be moved between an extended position in contact with the inner surface 15 of production tubing 12 as illustrated in FIG. 5 and a disengaged position in which sealing member 100 is drawn away from the inner surface of production tubing 12 for removal.

Support structure 102 preferably includes an upper assembly 104 and a lower assembly 106 that are connected together for movement relative to one another. The movement of the upper assembly 104 with respect to the lower assembly 106 moves sealing member 100 between an engaged position with the interior surface of production tubing 12 and a disengaged position. Preferably, upper assembly 104 and lower assembly 106 are slideably engaged for relative sliding movement in the axial direction. When the upper and lower assemblies are in a contracted position, sealing member 100 is forced into engagement with production tubing 12, and when they are in an extended position, sealing member 100 is pulled inwardly away from production tubing 12.

Preferably, support structure 102 is designed such that hydraulic pressure exerted by column of fluid 44 against upper assembly 104 holds support structure 102 in its contracted position while retrievable object 16 is moved to a desired location. Upper assembly 104 includes a top end 108 that has an upper surface 110. Upper surface 110 preferably has a greater surface area than the area of the cross section of the annular space between top end 108 and the inside surface of production tubing 12. In other words, the hydraulic force exerted by column of fluid 44 tends to force support structure 102 to a contracted position. This, in turn, maintains sealing member 100 in engagement with the interior surface of production tubing 12 during pressurized deployment of object 16.

To remove pump-down tool 10 or the combination of pump-down tool 10 and object 16, a reverse or upward, axial force is applied to wireline 34. This force tends to slide upper assembly 104 to an extended position relative to lower assembly 106, and sealing member 100 is drawn away from production tubing 12. When disengaged, the pump-down tool and any attached components may readily be removed or retrieved through production tubing 12.

An example of this embodiment of pump-down tool 10 is illustrated in a partial cross-sectional view in FIGS. 6 and 7. Upper assembly 104 includes top end 108 connected to or integrally formed with an upper annular sleeve 112 having an outer annular recessed portion 114. Sealing member 100 is attached to upper annular sleeve 112 at an upper attachment region 116 disposed above annular recessed portion 114. Sealing member 100 is attached by a fastener 117, such as a retention band or a plurality of screws. Additionally, annular recessed portion 114 is defined by an upper abutment surface 118 and a lower abutment surface 120 formed on an annular lip 121.

Lower assembly 106 is defined by a bottom attachment end 122 designed for attachment to latching device 32. Lower assembly 106 also includes a lower annular sleeve 124 that is slideably engaged with upper annular sleeve 112. Specifically, lower annular sleeve 124 includes an interior annular recessed portion 126 that slideably receives annular lip 121. Annular sleeve 124 also includes an expanded region 128 that is slideably engaged with outer annular recess portion 114 of upper assembly 104. The arrangement of expanded region 128, interior annular recess portion 126, annular lip 121 and abutment surfaces 118 and 120 permit limited, axial, sliding motion of upper assembly 104 relative to lower assembly 106. Sealing member 100 is attached to lower assembly 106 at a lower attachment region 130 by an appropriate fastener 131, such as a retention band or a plurality of screws.

As illustrated best in FIG. 6, when support structure 102 is in a contracted position, expanded region 128 abuts upper abutment surface 118. In this position, the sealing member 100 is forced radially outwardly into contact with the interior surface 15 of production tubing 12. However, once a reverse, tensile force is applied to wireline 34, upper assembly 104 is moved to an extended position in which an opposite side of expanded region 128 abuts lower abutment surface 120, as best illustrated in FIG. 7. In this expanded position, sealing member 100 is pulled between upper attachment region 116 and lower attachment region 130 on lower assembly 106. The sealing member 100 is drawn away from the interior surface of production tubing 12 to permit easy withdrawal of the pump-down tool or the combined pump-down tool and retrievable object.

The use of pump-down tools, such as those illustrated in FIGS. 3 through 7, facilitate the deployment of objects, such as progressing cavity pumps, through deviated wells even when connected only to a wireline. Additionally, the unique design of the pump-down tool provides for easy withdrawal of the tool after deployment of the progressing cavity pump and/or other components. It will be understood, however, that the foregoing description is of preferred embodiments of this invention, and that the invention is not limited to the specific forms shown. For example, a variety of sealing members may be utilized; a variety of latching mechanisms and wireline systems may be used with the pump-down device; the types of wells in which the present system and method are utilized can vary greatly; and the size and arrangement of pump-down tool components may be adjusted for specific applications. These and other modifications may be made in the design and arrangement of the elements without departing from the scope of the invention as expressed in the appended claims.

What is claimed is:

1. A method of deploying a downhole tool in a deviated well having a production tubing disposed within a wellbore casing, comprising:

attaching a wireline deployed pump-down tool to a downhole tool to form a tool string;

lowering the tool string into the production tubing;

forming a seal between the wireline deployed pump-down tool and an interior surface of the production tubing; and pushing the tool string to a desired location by applying a hydraulic pressure to the wireline deployed pump-down tool.

2. The method as recited in claim 1, further comprising applying a sufficient tensile load to the wireline to break the seal between the wireline deployed pump-down tool and the interior surface.

3. The method as recited in claim 1, wherein pushing comprises moving the tool string through a deviated section of the production tubing.

4. The method as recited in claim 3, wherein moving includes moving the tool string through a generally horizontal section of the production tubing.

5. The method as recited in claim 1, wherein attaching includes attaching the wireline deployed pump-down tool to a progressing cavity pump.

6. The method as recited in claim 1, wherein forming a seal includes applying a sufficient force against the wireline deployed pump-down tool to cause an axial contraction of the pump-down tool.

7. The method as recited in claim 6, further comprising applying a sufficient tensile load to the wireline to break the seal between the wireline deployed pump-down tool and the interior surface.

8. The method as recited in claim 6, further comprising applying a sufficient tensile load to the wireline deployed pump-down tool to cause an axial extension of the wireline deployed pump-down tool.

9. A wireline deployed pump-down tool system for deploying a downhole tool through a tubing in a deviated well, comprising:

a wireline deployed pump-down tool including:

an upper assembly to which a wireline deployment system may be attached;

a lower assembly to which a downhole tool may be attached; and a flexible member connected between the upper assembly and the lower assembly;

wherein when the upper assembly and the lower assembly are engaged at a first position, the flexible member is moved into contact with an interior surface of the tubing, further wherein when the upper assembly and the lower assembly are engaged in a second position, the flexible member is disengaged from the interior surface.

10. The wireline deployed pump-down tool of claim 9, wherein as a tensile force is applied to the upper assembly by a wireline, the upper assembly is extended from the lower assembly and the flexible member is disengaged from the interior surface.

11. The wireline deployed pump-down tool of claim 10, wherein when the upper assembly and the lower assembly are moved to a contracted position, the flexible member is moved into contact with the interior surface.

12. The wireline deployed pump-down tool of claim 11, further comprising a detachable progressing cavity pump that may be attached to and detached from the wireline deployed pump-down tool, wherein pressure may be applied to the wireline deployed pump-down tool to move the progressing cavity pump through a deviated well.

13. A method of deploying a downhole tool through a tubing disposed in a deviated well, comprising:

attaching a pump-down tool to a progressing cavity pump;

lowering the progressing cavity pump and the pump-down tool into the tubing;

forming a seal between the pump-down tool and an interior surface of the tubing;

applying a pressure to the pump-down tool; and moving the progressing cavity pump through a deviation in the tubing that would otherwise hinder the movement of the progressing cavity pump.

14. The method as recited in claim 13, further comprising applying a sufficient tensile load to the wireline to break the seal between the pump-down tool and the interior surface.

15. The method as recited in claim 14, further comprising forming the pump-down tool with a plurality of elastomeric seals.

16. The method as recited in claim 14, further comprising forming the pump-down tool as an adjustable member able to move an elastomeric seal into and out of engagement with the interior surface.

17. The method as recited in claim 16, wherein forming includes connecting an elastomeric seal between a pair of pump-down tool members that are slideably engaged with one another to selectively move the elastomeric seal between a radially extended and a radially contracted position.

18. The method as recited in claim 13, wherein moving includes moving the progressing cavity pump through a deviation of at least thirty degrees.

19. The method as recited in claim 13, wherein moving includes moving the progressing cavity pump through a deviation of at least forty-five degrees.

20. The method as recited in claim 13, wherein moving includes moving the progressing cavity pump through a deviation of approximately ninety degrees or more.

* * * * *